US012117264B2

(12) United States Patent
Merems

(10) Patent No.: US 12,117,264 B2
(45) Date of Patent: Oct. 15, 2024

(54) EFFECTOR INLET COVER, AND METHOD OF SEPARATION

(71) Applicant: Raytheon Company, Tewksbury, MA (US)

(72) Inventor: Paul A. Merems, Tucson, AZ (US)

(73) Assignee: Raytheon Company, Tewksbury, MA (US)

( * ) Notice: Subject to any disclaimer, the term of this patent is extended or adjusted under 35 U.S.C. 154(b) by 0 days.

(21) Appl. No.: 17/823,931

(22) Filed: Aug. 31, 2022

(65) Prior Publication Data

US 2024/0068774 A1 Feb. 29, 2024

(51) Int. Cl.
*F41F 3/077* (2006.01)

(52) U.S. Cl.
CPC ..... *F41F 3/077* (2013.01)

(58) Field of Classification Search
CPC ..... F41F 3/077; F41F 3/042; F41F 3/045
See application file for complete search history.

(56) References Cited

U.S. PATENT DOCUMENTS 3,706,281 A 12/1972 Hatakeyama
3,721,196 A 3/1973 Willis et al.
3,731,837 A * 5/1973 Platts ..... F16J 13/08 220/315
4,301,708 A * 11/1981 Mussey ..... F41F 3/077 89/1.817
4,867,357 A 9/1989 Inglis et al.
6,311,604 B1 11/2001 Foris et al.
7,506,572 B1 * 3/2009 Hombeck ..... F42B 14/06 89/31

(Continued)

FOREIGN PATENT DOCUMENTS

DE 2639719 3/1978
EP 2060867 5/2009

(Continued)

OTHER PUBLICATIONS

"International Application Serial No. PCT US2023 022636, International Search Report mailed Feb. 19, 2024", 5 pgs.

(Continued)

*Primary Examiner* — Derrick R Morgan
(74) *Attorney, Agent, or Firm* — Schwegman Lundberg & Woesser, P.A.

(57) ABSTRACT

A cover for an effector, such as a projectile, missile, or gun-launched effector, includes two parts that are translatable relative to one another, such that the cover separates in stages as the effector launches. The cover includes an outer cover portion that is made up of multiple outer cover segments that together define a central opening through which part of an inner cover portion extends. In a launch of the effector, the effector first makes contact with the inner cover portion. This pushes the inner cover portion forward, breaking the attachment with the outer cover portion, and allowing the inner cover portion to translated forward relative to the outer cover portion. As the inner cover portion translates forward relative to the outer cover portion, the inner cover portion eventually makes contact with the outer cover portion, with both being pushed forward, and separating from the launcher.

19 Claims, 4 Drawing Sheets

(56) References Cited

U.S. PATENT DOCUMENTS

| | | | | |
|---|---|---|---|---|
| 7,685,920 | B2 * | 3/2010 | Paul | F41F 3/077 89/1.817 |
| 2004/0083878 | A1 * | 5/2004 | Paul | F41F 3/077 89/1.817 |
| 2006/0090635 | A1 * | 5/2006 | Paul | F41F 3/077 89/1.817 |
| 2007/0074636 | A1 | 4/2007 | Rieger et al. | |
| 2011/0126474 | A1 * | 6/2011 | Snediker | F42B 39/00 277/606 |

FOREIGN PATENT DOCUMENTS

| | | |
|---|---|---|
| RU | 2218539 | 12/2003 |
| WO | 2024054262 | 3/2024 |

OTHER PUBLICATIONS

"International Application Serial No. PCT US2023 022636, Written Opinion mailed Feb. 19, 2024", 6 pgs.

* cited by examiner

EFFECTOR INLET COVER, AND METHOD OF SEPARATION

FIELD

The disclosure is in the field of camera assemblies with cryogenic detectors, such as infrared detectors.

BACKGROUND

Effectors may have inlets, such as ramjet inlets, that are damageable during handling, such as during loading into a barrel of a launcher such as a gun. Launching, such as gun launching, may produce forces that also damage such inlets.

SUMMARY

A cover may be used to protect an inlet, such as a ramjet inlet, of an effector, that protects the inlet during handling and launch. The cover may be structurally robust so as to withstand launch forces, while allowing for separation of the cover passively during the launch process.

According to an aspect of the disclosure, a cover comprising: an outer cover portion that includes multiple outer cover segments butted up against one another, wherein the outer cover portion defines a central opening that has a central axis; and an inner cover portion that protrudes through the central opening; wherein the inner cover portion includes multiple inner cover segments butted up against one another; and wherein the inner cover portion is translatable relative to the outer cover portion in an axial direction.

According to an embodiment of any paragraph(s) of this summary, the outer cover portion has an annular shape.

According to an embodiment of any paragraph(s) of this summary, the outer cover is axisymmetric about the central axis.

According to an embodiment of any paragraph(s) of this summary, the inner cover is axisymmetric about the central axis.

According to an embodiment of any paragraph(s) of this summary, the outer cover portion includes three or more of the multiple outer cover segments.

According to an embodiment of any paragraph(s) of this summary, the outer cover portion is made up of three of the multiple outer cover segments.

According to an embodiment of any paragraph(s) of this summary, the inner cover portion includes three or more of the multiple inner cover segments.

According to an embodiment of any paragraph(s) of this summary, the inner cover portion is made up of three of the multiple inner cover segments.

According to an embodiment of any paragraph(s) of this summary, the outer cover portion and the inner cover portion are joined by breakable fasteners.

According to an embodiment of any paragraph(s) of this summary, the outer cover portion and the inner cover portion are connected by pins.

According to an embodiment of any paragraph(s) of this summary, translation of the inner cover portion relative to the outer cover portion disengages the pins.

According to an embodiment of any paragraph(s) of this summary, the pins include first pins at a face surface of the cover, and second pins at a rear of the cover, the rear of the cover being opposite the face surface.

According to an embodiment of any paragraph(s) of this summary, the outer cover segments overlap the inner cover segments, with the outer cover segments circumferentially offset from the inner cover segments.

According to an embodiment of any paragraph(s) of this summary, the outer cover segments have recesses that receive front flanges of the inner cover segments.

According to an embodiment of any paragraph(s) of this summary, the front flanges define an inner part of a face surface of the cover.

According to an embodiment of any paragraph(s) of this summary, the outer cover segments define an outer part of the face surface of the cover.

According to an embodiment of any paragraph(s) of this summary, the outer part of the face surface is annular and surrounds the inner part of the face surface.

According to an embodiment of any paragraph(s) of this summary, the outer part of the face surface has a greater surface area than the inner part of the face surface.

According to an embodiment of any paragraph(s) of this summary, the inner cover portion defines a central hollow, configured for receiving a nose of the effector.

According to an embodiment of any paragraph(s) of this summary, the nose of the effector is used to push the inner cover portion.

According to an embodiment of any paragraph(s) of this summary, the cover further includes an O-ring around the outer cover portion, configured to form a seal with the effector.

According to an embodiment of any paragraph(s) of this summary, the outer cover segments each have a shoulder that is thicker than an axial extension that extends in the axial direction away from the shoulder.

According to an embodiment of any paragraph(s) of this summary, the axial extensions are tapered in thickness.

According to an embodiment of any paragraph(s) of this summary, the shoulders are thickest parts of the outer cover segments.

According to an embodiment of any paragraph(s) of this summary, the inner cover segments have radially outer surfaces that engage and support inner wall surfaces of the outer cover segments.

According to an embodiment of any paragraph(s) of this summary, the cover is in combination with an effector covered in part by the cover.

According to an embodiment of any paragraph(s) of this summary, the effector is a missile.

According to an embodiment of any paragraph(s) of this summary, the effector is gun launched.

According to an embodiment of any paragraph(s) of this summary, the effector has a propulsion system.

According to an embodiment of any paragraph(s) of this summary, the propulsion system is a ramjet, and wherein the cover covers an inlet of the ramjet.

According to another aspect of the disclosure, an effector assembly includes: an effector; and a cover that separably covers a portion of the effector, the cover including: an outer cover portion that includes multiple outer cover segments butted up against one another, wherein the outer cover portion defines a central opening that has a central axis; and an inner cover portion that protrudes through the central opening; wherein the inner cover portion includes multiple inner cover segments butted up against one another; and wherein the inner cover portion is translatable relative to the outer cover portion in an axial direction.

According to yet another aspect of the disclosure, a method of launching an effector includes the steps of: translating an inner cover portion of a cover, relative to an outer cover portion of the cover, by pressing against the inner cover portion with effector; after the translating, detaching the outer cover portion by pushing against the outer cover portion with the inner cover portion; and after the detaching, separating the inner cover portion and the outer cover portion from the effector.

According to yet another aspect of the disclosure, a cover includes: outer cover segments together forming an outer cover; inner cover segments extending through a central opening defined by the outer cover segments; wherein the outer cover segments overlap boundaries between the inner cover segments.

While a number of features are described herein with respect to embodiments of the disclosure; features described with respect to a given embodiment also may be employed in connection with other embodiments. The following description and the annexed drawings set forth certain illustrative embodiments of the disclosure. These embodiments are indicative, however, of but a few of the various ways in which the principles of the disclosure may be employed. Other objects, advantages, and novel features according to aspects of the disclosure will become apparent from the following detailed description when considered in conjunction with the drawings.

BRIEF DESCRIPTION OF THE DRAWINGS

The annexed drawings, which are not necessarily to scale, show various aspects of the disclosure.

DETAILED DESCRIPTION

A cover for an effector, such as a projectile, missile, or gun-launched effector, includes two parts that are translatable relative to one another, such that the cover separates in stages as the effector launches. The cover includes an outer cover portion that is made up of multiple outer cover segments that together define a central opening through which part of an inner cover portion extends. The inner cover portion includes multiple inner cover segments. The inner cover portion is initially attached to the outer cover portion.

In a launch of the effector, the effector first makes contact with the inner cover portion. This pushes the inner cover portion forward, breaking the attachment with the outer cover portion, and allowing the inner cover portion to translated forward relative to the outer cover portion. As the inner cover portion, still being pushed forward by contact with the effector, translates forward relative to the outer cover portion, the inner cover portion eventually makes contact with the outer cover portion, with both being pushed forward, and separating from the launcher. The inner and outer cover portions then separate from the effector, and parts of the cover portions separate from one another.

Figure 1:
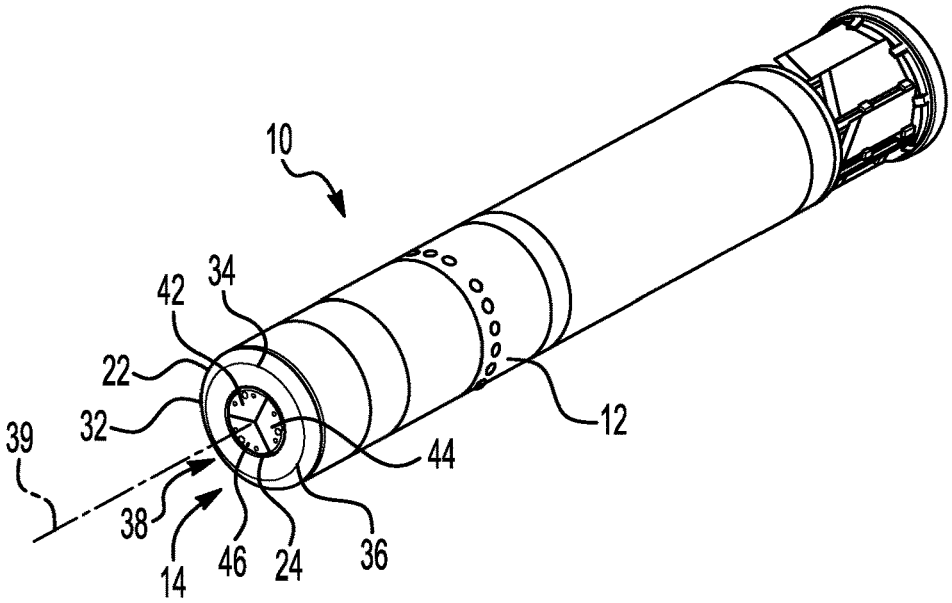
FIG. 1 is an oblique view of an effector assembly in accordance with an embodiment.

FIG. 1 shows an effector assembly 10 that includes an effector 12. The effector 12 may be a launched weapon or other device, for example launched from a gun or tube. The effector 12 may be a projectile or missile, for example. In the illustrated embodiment the effector 12 is a powered device, having a ramjet engine.

Figure 2:
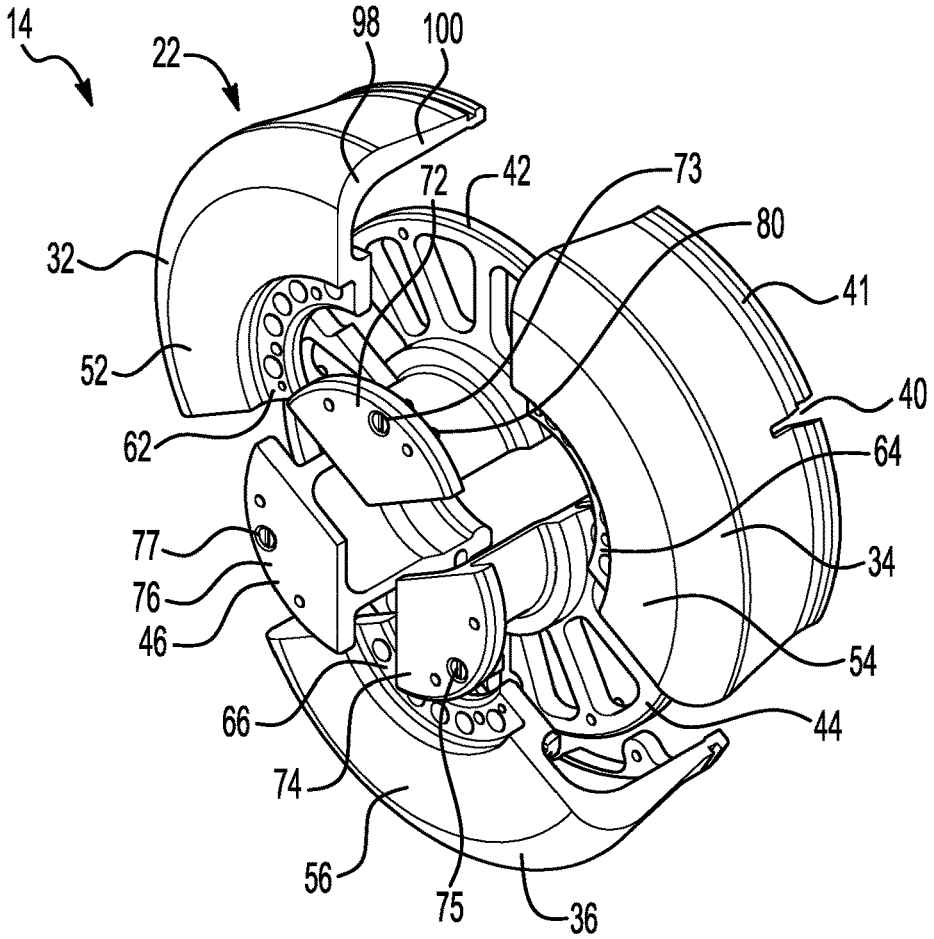
FIG. 2 is an exploded view of a cover of the effector assembly of FIG. 1.

A cover 14 covers a front of the effector 12, and is initially coupled to the effector 12. With reference in addition to FIG. 2, the cover 14 includes an outer cover portion 22 and an inner cover portion 24. The outer cover portion 22 is made up of three outer cover segments 32, 34, and 36. The outer cover segments 32-36 are all circumferentially-coupled-together segments of the outer cover portion 22, fitting together to constitute an annular outer cover portion 22. The segments 32-36 together define a central opening 38 at the center of the outer cover portion 22, at a central axis 39 of the outer cover portion 22 and the cover 14. The outer cover portion 22 and the inner cover portion 24 may both be substantially axisymmetric about the central axis 39. The segments 32-36 may all be substantially identical in configuration.

The outer cover segments 32, 34, and 36 have notches in them, such as a notch 40 in the cover segment 34. The notches are present in order to accommodate features the effector 12, such as ribs, and may be omitted.

The outer cover segments 32-36 have recesses in them for receiving O-ring segments, such as an O-ring segment 41 received by and in a recess (groove) of the cover segment 32. The O-ring segments together provide a seal around the outer surface of the cover 14, preventing ingress or moisture or dirt to interior parts of the effector 12, for example.

The inner cover portion 24 has inner cover segments 42, 44, and 46, that fit together in a circumferential direction. The inner cover segments 42-46 may all be substantially identical to one another in configuration.

The outer cover segments 32-36 have respective front faces 52, 54, and 56, which have respective recesses 62, 64, and 66. The recesses 62-66 receive front flanges 72, 74, and 76 of the inner cover segments 42-46. This may result in a flat front surface of the cover 14, composed of a combination of the front faces 52-56 and front surfaces of the front flanges 72-76. Breakaway screws 73, 75, and 77 may be used to attach the front flanges 72, 74, and 76 to the inner cover segments 42-46. The screws 73, 75, and 77 breaking during launch, allowing the inner cover portion 24 to axially relative to the outer cover portion 22.

The outer cover segments 32-36 may be offset from the inner cover segments 42-46, such that locations of the boundary between adjacent of the outer cover segments 32-36 do not align with the boundary between adjacent of the inner cover segments 42-46. This offset overlapping of the segments 42-46 with the segments 32-36 provides better structural strength to the cover 14.

The outer cover segments 32-36 and the inner cover segments 42-46 may be made of aluminum, or another suitable material. The breakaway fasteners 73, 75, and 77 may be made of brass, nylon, or another suitable material.

In the illustrated embodiment the cover 14 has three of the outer cover segments 32, 34, and 36, and three of the inner cover segments 42, 44, and 46. In other embodiments there may be more than three outer cover segments and/or more than three inner cover segments.

The flanges 72, 74, and 76 have a series of pins 80 that prevent circumferential movement between the inner cover portion 24 and the outer cover portion 22. There may be two of the pins 80 on the back of each of the flanges 72, 74, and 76, with the pins of the individual of the flanges 72, 74, and 76 engaging recesses in different of the outer cover segments 32-36.

Figure 3:
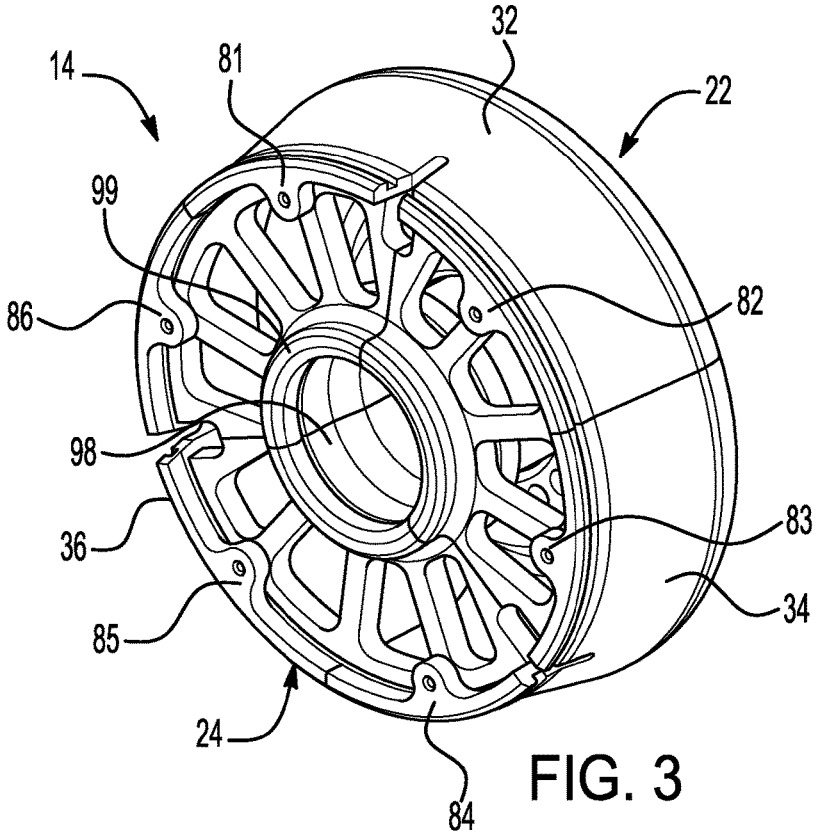
FIG. 3 is a rear oblique view of the cover of FIG. 2, in a locked configuration.
Figure 4:
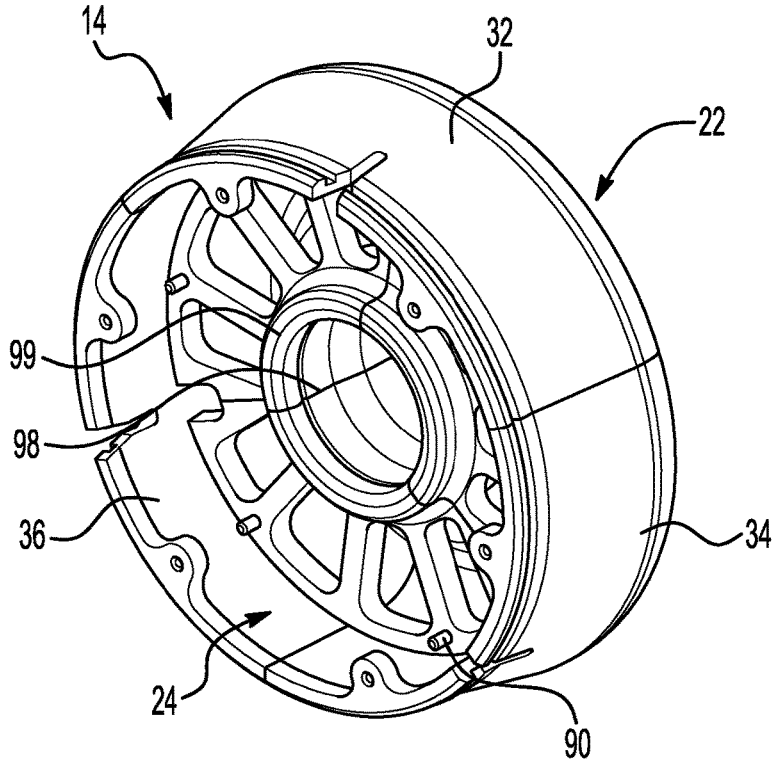
FIG. 4 is a rear oblique view of the cover of FIG. 2, in an unlocked configuration.

Referring now in addition to FIGS. 3 and 4, the outer cover segments 32-36 have bosses 81, 82, 83, 84, 85, and 86 for coupling the outer cover segments 32, 34, and 36, with the inner cover segments 42, 44, and 46 (FIG. 2). The bosses 81-86 may receive suitable respective of pins 90 of the inner cover segments 32, 34, and 36. The pins 90, equal in number to the number of the bosses 81-86, are in rear portions of the inner cover segments 32, 34, and 36. The coupling of the pins 90 to the bosses 81-86 provides structural strength to the cover 14, while allowing for separation of the inner cover portion 22 from the outer cover portion 24 during launch. This enables the inner cover portion 22 to slide forward relative to the outer cover portion 24 during launch of the effector 12, as described further below.

There may be in one or more set screws or bolts (not shown) that hold the effector 12 in place during transportation and prior to launch. The set screws or bolts may be configured to shear off during launch, when the cover 14 separates from the effector 12.

The inner cover segments 42, 44, and 46 together define a central hollow 98 on a rearward side of the inner cover portion 24. The central hollow 98 receives a nose of the effector 12, as discussed further below. The central hollow 98 may be bounded at the rear by a rounded edge 99 that engages the effector nose.

Additional aspects of the cover 14 may enhance its structural integrity. For example the outer cover segments 32-36 may have different thicknesses of material in different parts, for example being thicker at a shoulder 98 of the cover segment 32 (FIG. 2) where the cover segment 36 transitions from extending in an axial direction (along the side of the effector 12, to extending in a radial direction, cover (part of) the front of the effector 12. An axial extension 100 (FIG. 2) away from the shoulder 98 may be tapered, reducing in thickness as the axial extension 100 moves away from the thicker shoulder 98. The tapered axial extension 100 may be configured for engaging a correspondingly-shaped portion of the effector 12, for example a portion of the effector 12 that functions as an air inlet, such as ramjet inlet, as described further below.

In addition the rear portions of the inner cover segments 32, 34, and 36 may extend radially outward to contact inner walls of the axial extensions (such as the axial extension 100) of the outer cover segments 42, 44, and 46. This contact between the inner cover portion 22 and the outer cover portion 24 provides structural strength to the cover 14.

These various details that provide structural characteristics of the cover 14 may be important in configuration of the cover 14 in certain embodiments, though such features should be considered optional rather than necessary. The structural characteristics may be advantageous in withstanding the forces on the effector 12 (and the cover 14) during launch, such as a gun launch. It may be advantageous and/or desirable for the cover 14 to act as a solid piece to withstand forces from a gun launch of the effector 12, to reconfigure as part of the separation process, and for parts of the cover 14 (the inner cover segments 32, 34, and 36, and the outer cover segments 42, 44, and 46) to separate from one another as the cover 14 separates from the effector 12.

Figure 5:
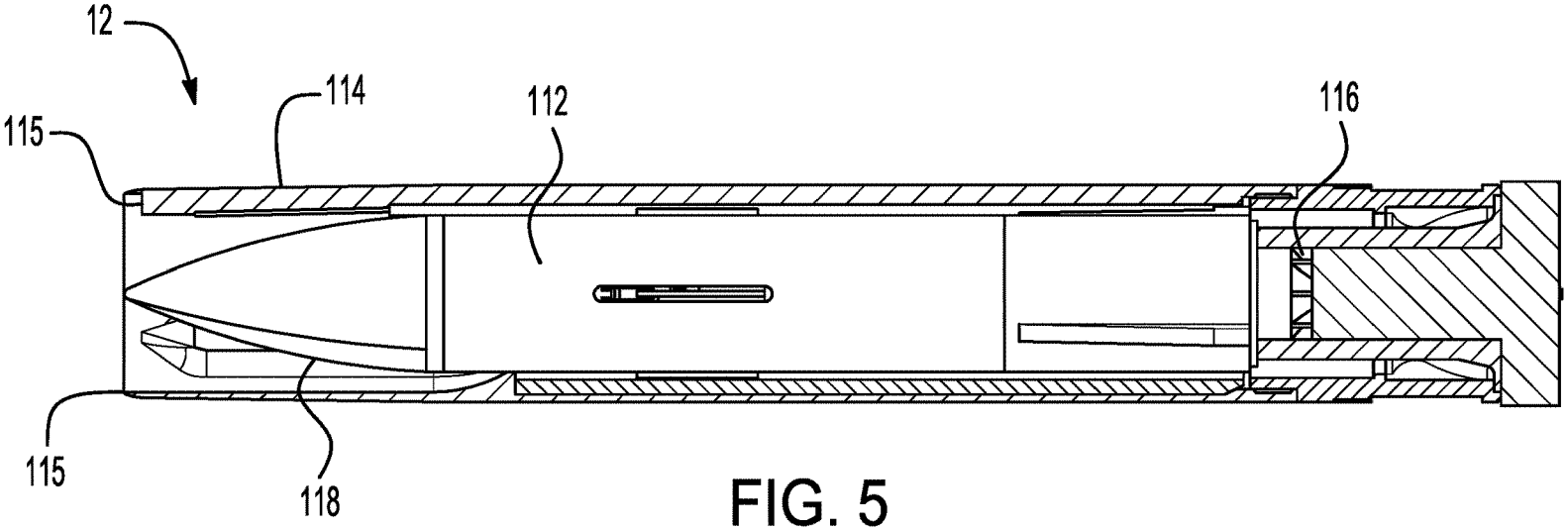
FIG. 5 is a side sectional view of an effector of the effector assembly of FIG. 1, in a stowed condition.
Figure 6:
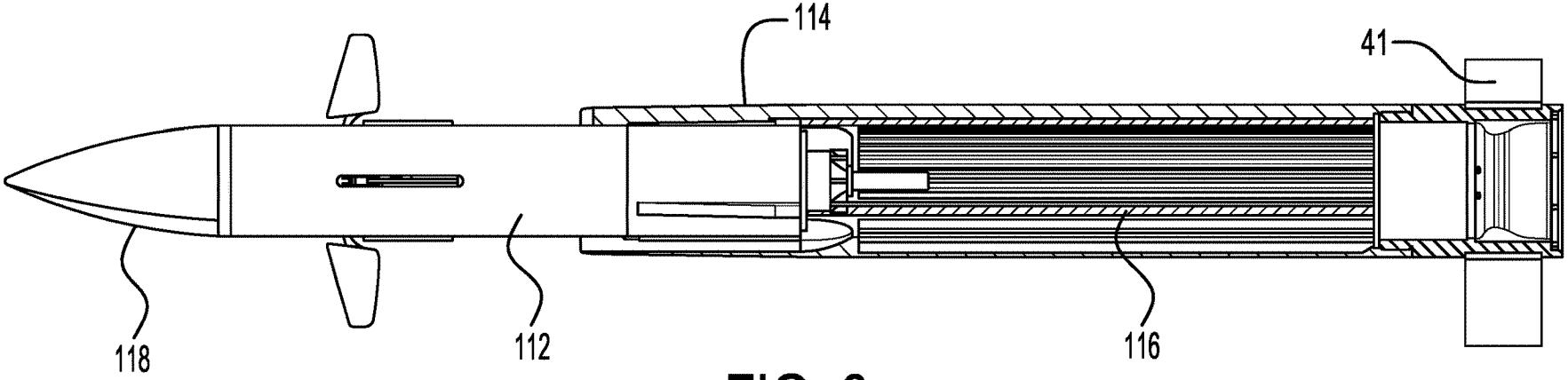
FIG. 6 is a side sectional view of the effector of FIG. 5 in a deployed condition.

The separation of the cover 14 occurs as part of a gun launch of the effector 12, as the effector 12 emerges from the muzzle of a launcher (gun) in a stowed configuration (FIG. 5), and pushes off the cover 14 (FIG. 2) to transition to a deployed configuration, which is shown in FIG. 6. As part of the transition a center body 112 of the effector 12 translates relative to an outer portion (or outer housing) 114 of the effector 12. The outer portion 114 may operate as a ramjet inlet (or other inlet) for an engine 116 of the effector 12. The outer portion 114 may have a sharp forward edge 115 that is suitable for the leading edge of an inlet. The engine 116 may be a ramjet that propels the effectors 12 in flight. A nose 118 of the effector 12 is attached to a forward part of the center body 112.

The center body 112 may be axially translatable relative to the outer body 114 and movable in a forward direction relative to the direction of travel of the effector 12. The movement of the center body 112 relative to the outer body 114 may provide a telescoping-type arrangement for the airframe of the effector 12. The ramjet assembly 116 may be defined by a ramjet inlet formed in the outer body 114 that receives airflow during flight of the effector 12. The movement of the center body 112 also exposes or opens a radially positioned ramjet fuel chamber to enable additional fuel to be provided to a ramjet of the effector 12. Accordingly, a range of the effector 12 is extended using a telescoping or morphing airframe that is able to fit within the existing packaging requirements of the effector 12. Further details of an embodiment of the effector 12 may be found in co-owned U.S. patent application Ser. No. 17/842,200, filed Jun. 16, 2022, which is incorporated herein in its entirety.

Figure 7:
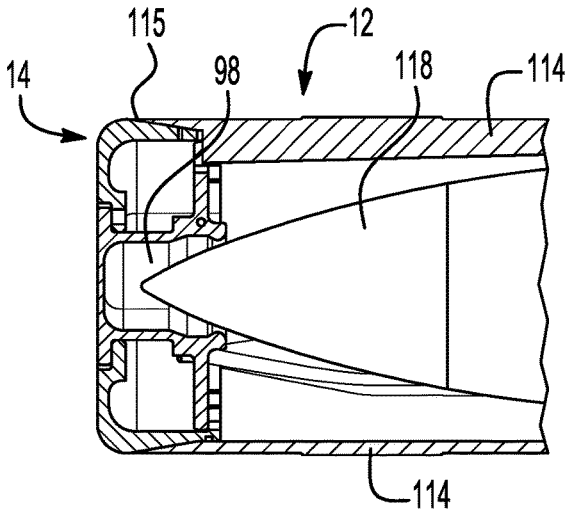
FIG. 7 is a side sectional view of a portion of the effector assembly, in a first step of removal of the cover during launch.
Figure 8:
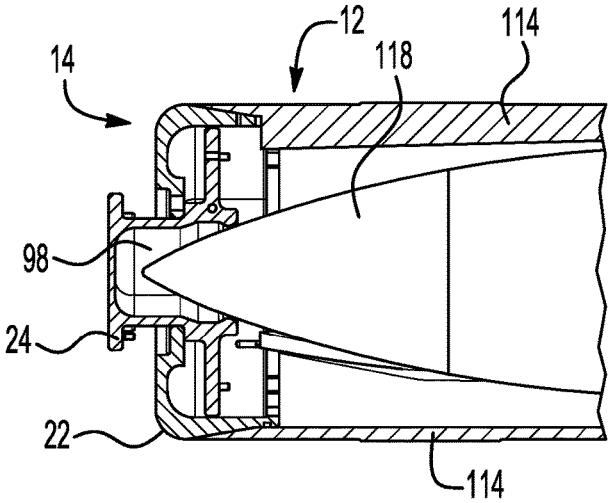
FIG. 8 is a side sectional view of the portion of the effector assembly at a second step of removal of the cover during launch.
Figure 9:
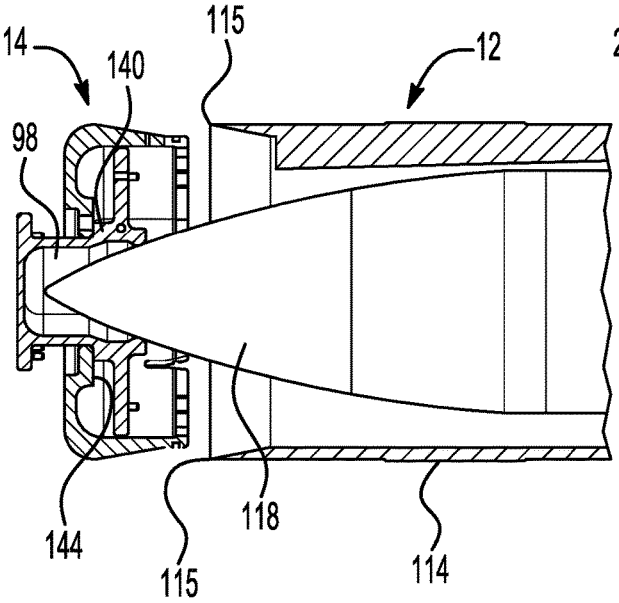
FIG. 9 is a side sectional view of the portion of the effector assembly at a third step of removal of the cover during launch.

FIGS. 7-9 show steps the procedure is shown for separation of the cover 14 from the effector 12. FIG. 7 shows the configuration at the beginning of the process, with the cover 14 over the effector 12, and with the effector in the stowed configuration. The effector nose 118 extends into the hollow 98 at the center of the inner cover portion 24. As part of the launch and cover separation process the nose 118 first pushes forward on the inner cover portion 24.

FIG. 8 shows movement of the inner cover portion 24 relative to the outer cover portion 22 as the effector nose 118 pushes on the inner cover portion 24. This allows for forward movement against pressure of only a part of the forward surface of the cover 14. The front face area of the inner cover portion 24 may be less than 60% of the total front face area of the cover 14. The air force holding the cover 14 in place may be significant, for example 7560-17, 800 N (1700-4000 lbs), so rather than having this force overcome by the effector 12 all at once, it may be advantageous to have the effector 12 (the effector nose 118) initially have to move forward only a portion of the cover 14.

The translation of the inner cover portion 24 relative to the outer cover portion 22 also serves to unlock the inner cover portion 24. As part of that the pins 90 (FIG. 4) disengage from the bosses 81-86 (FIG. 3), the screws or bolts (fasteners) 73, 75, and 77 (FIG. 2) break, and the pins 80 disengage from the holes in the outer cover segments 32, 34, and 36 (FIG. 2). During the translation of the inner cover portion 24 the outer edge of the inner cover portion 24 is still in contact with an inner wall surface of the outer cover portion 22 (the inner surface of the axial extension 100).

FIG. 9 shows a further step in the process, with the effector nose 118 having separated the cover 14 from the effector outer housing 114. The relative translation of the cover portions 22 and 24 ends when a stop 140 on the inner cover portion 24 reaches a back surface 144 of the parts of the outer cover segments that have the recesses 62, 64, and 66 (FIG. 2) in them. Further forward motion of the effector nose 118 then moves both of the cover portion 22 and 22 as a unit, eventually separating the cover 14 from the effector outer housing 114.

After separation of the cover 14, the outer cover segments 32, 34, and 36 (FIG. 2) and the inner cover segments 42, 44, and 46 (FIG. 2) separate from one another. This separation may be accomplished through continued wedging apart of the segments by pressure from the effector nose 118, along with possibly centripetal separating forces from the axial rotation of the cover 14 and the effector 12.

Figure 10:
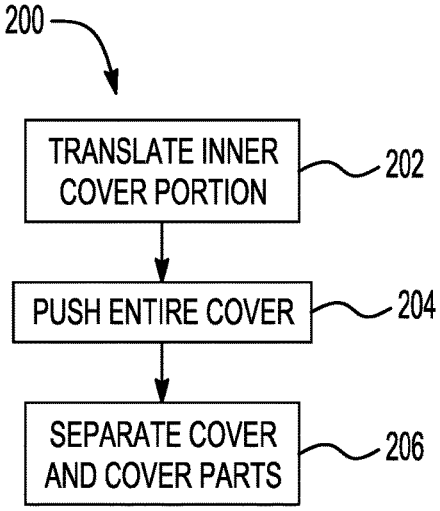
FIG. 10 is a high-level flow chart showing steps in a method of removal of a cover of an effector assembly, part of a method of launch of the effector assembly.

FIG. 10 shows a high-level flow chart of a method 200 of removal of the cover 14 (FIG. 1), as part of a launch process of the effector 12 (FIG. 1). In step 202 the effector nose 118 (FIG. 8) moves the inner cover portion 24 (FIG. 8) relative to the outer cover portion 22 (FIG. 8) by pushing against the inner cover portion 24. This mechanically unlocks the inner cover portion 24 from the outer cover portion 22. In step 204 the entire cover 14 separates from the effector outer housing 114 (FIG. 9). And finally, in step 206, the segments of the cover portions 22 and 24 separate from one another.

The cover 14 (FIG. 1) provides a cover that prevent damage to the inlet of the effector 12 (FIG. 1), for example protecting the sharp inlet of a ramjet from damage. The cover 14 is structurally strong, being able to withstand the forces of a gun launch. The cover also separates in stages, and then its segments fully disengage from one another after the cover 14 is pushed out of contact with the outer housing 114 (FIG. 9) of the effector 12. This is done without any sort of explosive or active separation mechanism.

Although the disclosure has been shown and described with respect to a certain embodiment or embodiments, equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the disclosure. In addition, while a particular feature of the disclosure may have been described above with respect to only one or more of several illustrated embodiments, such feature may be combined with one or more other features of the other embodiments, as may be desired and advantageous for any given or particular application.

What is claimed is:

1. A cover for use with an effector assembly comprising:

an outer cover portion that includes multiple outer cover segments butted up against one another, wherein the outer cover portion defines a central opening that has a central axis; and an inner cover portion that protrudes through the central opening; wherein the inner cover portion includes multiple inner cover segments butted up against one another; and wherein the inner cover portion is translatable relative to the outer cover portion in an axial direction.

2. The cover of claim 1, wherein the outer cover portion has an annular shape.

3. The cover of claim 1, wherein the outer cover is axisymmetric about the central axis.

4. The cover of claim 1, wherein the inner cover is axisymmetric about the central axis.

5. The cover of claim 1, wherein the outer cover portion and the inner cover portion are joined by breakable fasteners.

6. The cover of claim 1, wherein the outer cover portion and the inner cover portion are connected by pins.

7. The cover of claim 6, wherein translation of the inner cover portion relative to the outer cover portion disengages the pins.

8. The cover of claim 6, wherein the pins include first pins at a face surface of the cover, and second pins at a rear of the cover, the rear of the cover being opposite the face surface.

9. The cover of claim 1, wherein the outer cover segments overlap the inner cover segments, with the outer cover segments circumferentially offset from the inner cover segments.

10. The cover of claim 1, wherein the outer cover segments have recesses that receive front flanges of the inner cover segments.

11. The cover of claim 10, wherein the front flanges define an inner part of a face surface of the cover.

12. The cover of claim 11, wherein the outer cover segments define an outer part of the face surface of the cover.

13. The cover of claim 12, wherein the outer part of the face surface is annular and surrounds the inner part of the face surface.

14. The cover of claim 12, wherein the outer part of the face surface has a greater surface area than the inner part of the face surface.

15. The cover of claim 1, wherein the inner cover portion defines a central hollow, configured for receiving a nose of the effector.

16. The cover of claim 1, wherein the outer cover segments each have a shoulder that is thicker than an axial extension that extends in the axial direction away from the shoulder.

17. The cover of claim 1, wherein the inner cover segments have radially outer surfaces that engage and support inner wall surfaces of the outer cover segments.

18. The cover of claim 1, in combination with an effector covered at least in part by the cover.

19. An effector assembly comprising:

an effector; and a cover that separably covers a portion of the effector, the cover including:

an outer cover portion that includes multiple outer cover segments butted up against one another, wherein the outer cover portion defines a central opening that has a central axis; and an inner cover portion that protrudes through the central opening;

wherein the inner cover portion includes multiple inner cover segments butted up against one another; and wherein the inner cover portion is translatable relative to the outer cover portion in an axial direction.

* * * * *